US006752380B1

(12) United States Patent
Taylor et al.

(10) Patent No.: US 6,752,380 B1
(45) Date of Patent: Jun. 22, 2004

(54) PRY BAR

(75) Inventors: Robert L. Taylor, Machesney Park, IL (US); Dennis Stupec, Rockford, IL (US); Don Dray, Rockford, IL (US)

(73) Assignee: Dasco Pro, Inc., Rockford, IL (US)

( * ) Notice: Subject to any disclaimer, the term of this patent is extended or adjusted under 35 U.S.C. 154(b) by 0 days.

(21) Appl. No.: 10/365,379

(22) Filed: Feb. 12, 2003

(51) Int. Cl.[7] ..... B25C 11/00
(52) U.S. Cl. ..... 254/25; 254/21
(58) Field of Search ..... 254/25, 21, 22, 254/131, 131.5; 81/45

(56) References Cited

U.S. PATENT DOCUMENTS

| | | | | | |
|---|---|---|---|---|---|
| 546,521 | A | | 9/1895 | Gatti | |
| 949,337 | A | * | 2/1910 | Trogner | 254/25 |
| 1,486,820 | A | | 3/1924 | Wilder | |
| 1,508,489 | A | | 9/1924 | Vlchek | |
| 2,026,581 | A | * | 1/1936 | Lane | 254/24 |
| 2,272,362 | A | | 2/1942 | Barker | |
| 2,906,498 | A | * | 9/1959 | Erwin | 254/25 |
| D197,205 | S | | 12/1963 | Estwing | |
| 3,134,574 | A | | 5/1964 | Reuterfors | |
| D202,687 | S | | 10/1965 | Estwing | |
| 3,522,932 | A | | 8/1970 | Nakasone | |
| 3,680,834 | A | | 8/1972 | Holloway | |
| 4,844,416 | A | | 7/1989 | Hand | |
| 5,577,711 | A | | 11/1996 | Shine | |
| 5,695,171 | A | | 12/1997 | Shine | |
| 5,695,172 | A | | 12/1997 | Hreha | |
| 5,957,429 | A | | 9/1999 | Khachatoorian | |
| 6,257,553 | B1 | * | 7/2001 | Khachatoorian | 254/25 |
| 6,488,266 | B2 | * | 12/2002 | Macor | 254/25 |
| 6,598,857 | B1 | | 7/2003 | Hernandez et al. | |

OTHER PUBLICATIONS

Ace Hardware, *1989 Spring Show Specials*, 7 pages.
Estwing, *World's First and Finest Solid Steel Striking Tools*, Catalog No. 289, © 1989 Estwing Mfg. Co., 2 pages.
Olympia 1996 Catalog, 3 pages.
Dasco Pro, *2–Piece DASCO BAR Kit*, 1 page from catalog, Applicant's admitted prior art.
Dasco Pro, Inc., *Dasco Pro Bars*, Catalog No. GC–87, 2 pages, 1987.
Dasco Pro, *Curved Gooseneck Bar*, Catalog, 1 page, 1997.

* cited by examiner

*Primary Examiner*—Lee D. Wilson
(74) *Attorney, Agent, or Firm*—Leydig, Voit & Mayer, Ltd.

(57) ABSTRACT

A pry bar comprises a shank portion and an integral U-shaped prying hook portion that is free of defined flats and instead has a continuous cam surface extending all the way from the apex of the U-shaped portion along the outer leg to the tip end. The pry bar includes axially extending channels in opposed sides of the shank portion such that the shank portion defines a generally I-shaped cross section with wider top and bottom beam portions and a narrower intermediate beam portion.

20 Claims, 4 Drawing Sheets

PRY BAR

FIELD OF THE INVENTION

This invention pertains to generally to hand tools and more specifically to pry bars used to move or pry objects.

BACKGROUND OF THE INVENTION

Pry bars are used to pry and move objects using leverage. A number of pry bar designs are known. Usually, pry bars are forged from steel bar material to provide sufficient strength to prevent breakage during use and as a result pry bars are relatively heavy. Pry bars also typically include prying tips at one or both ends, as disclosed for example, in U.S. Pat. No. 5,957,429 to Khachatoorian. As shown in the '429 patent, pry bars commonly employ U-shaped prying hooks at one end and a prying chisel at the other end. The U-shaped prying hook commonly defines a flat and an initial fulcrum point positioned intermediate along the outer leg of the U-shaped hook.

Improvements over existing pry bar designs are disclosed herein.

BRIEF SUMMARY OF THE INVENTION

According to one aspect of the present invention, a pry bar comprises a shank portion and an integral U-shaped prying hook that is free of defined flats and instead has a continuous cam surface extending all the way to the tip end. The U-shaped prying hook has an inner leg and an outer leg that meet at an apex and that extend in different transverse prying directions relative to the axis. The inner leg connects the outer leg to the shank portion. The outer leg includes an inner face and an outer cam face facing axially toward and axially away from the shank portion, respectively. The outer cam face continuously curves from the apex to the terminating tip.

According to another aspect of the present invention, the present invention provides a configuration for the shank portion that can be utilized to increase strength of a pry and/or decrease weight of a pry bar and/or provide for a good gripping surface for the pry bar. The pry bar includes axially extending channels in opposed sides of the shank portion. With channels, the shank portion defines a generally I-shaped cross section perpendicular to the axis having a height and a width, with wider top and bottom beam portions and a narrower intermediate beam portion.

DETAILED DESCRIPTION OF THE INVENTION

Figures 1, 2:
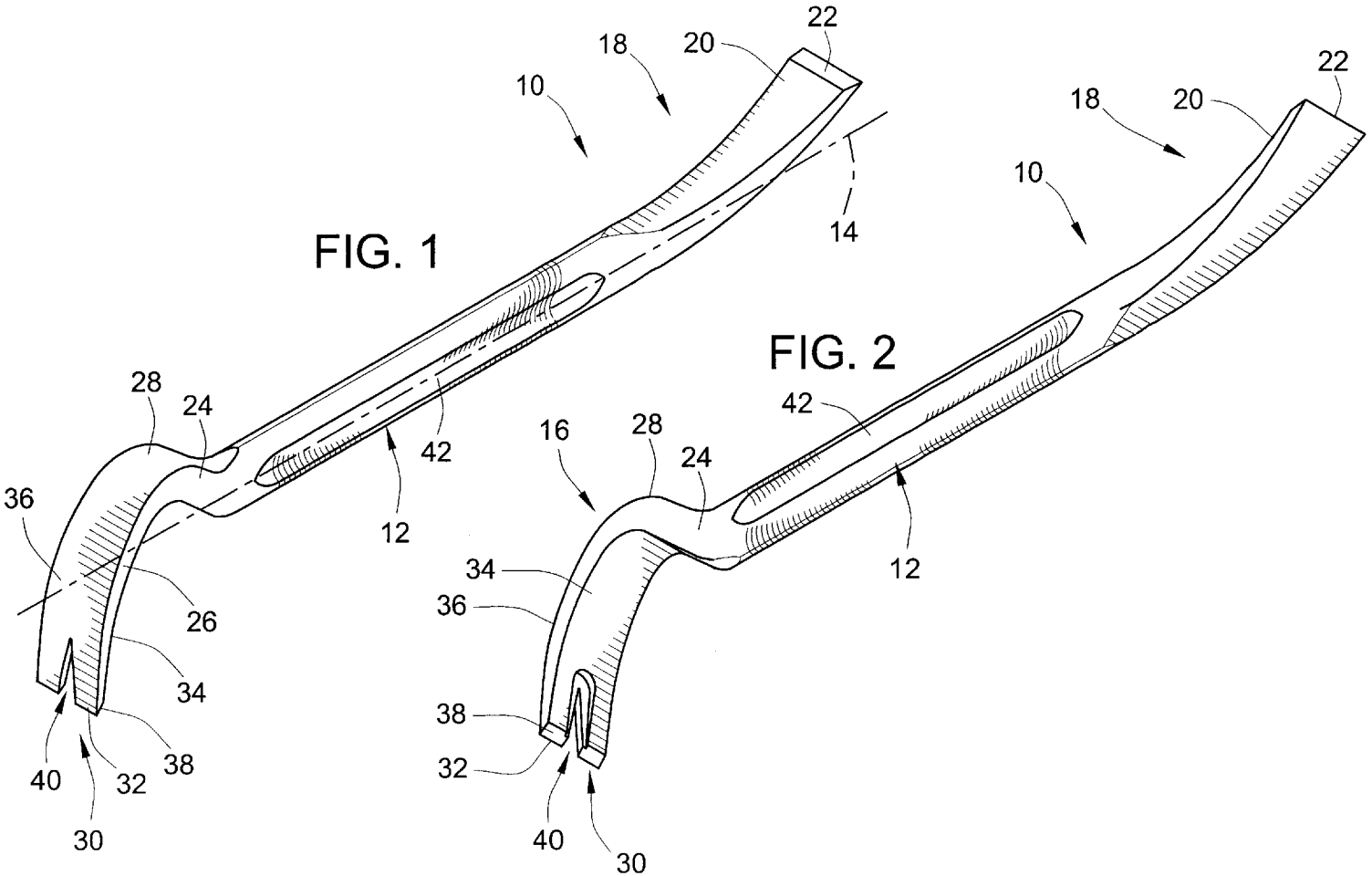
FIG. 1 is an isometric view of a pry bar in accordance with the present invention.
FIG. 2 is an isometric view of the pry bar as shown in FIG. 1, but inverted.
Figure 3:
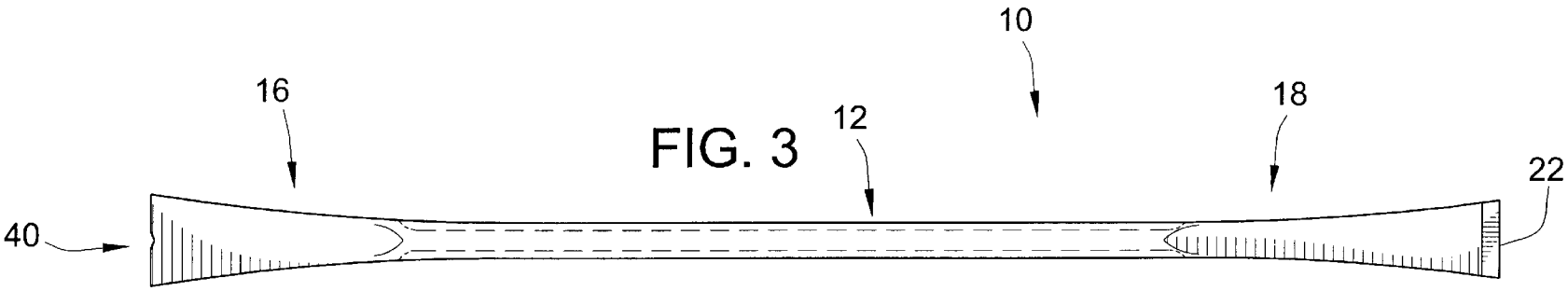
FIG. 3 is a top side view of the pry bar shown in prior Figures.

Referring to the Figures, a pry bar 10 is illustrated according to an embodiment of the present invention. The pry bar 10 is preferably made of steel or other sufficiently strong and rigid material. The pry bar 10 is preferably formed of forged steel and may be machined or ground for finishing. Heat treatment may be used to make the pry bar 12 more rigid. The pry bar 10 includes a shank portion 12 extending along an axis 14 and one or more prying tip ends shown as a U-shaped prying hook 16 and a prying chisel 18. The prying hook 16 and prying chisel 18 are integral and preferably unitarily formed with the shank portion 12.

The prying chisel 18 includes a curved tapered body 20 that converges in the vertical direction and widens in the lateral direction as it extends from the shank portion 12 toward a chisel edge 22. The prying chisel 18 preferably is pointed in the opposite direction of the prying hook 16.

The U-shaped prying hook 16 includes an inner leg 24 and an outer leg 26 that meet at an apex 28. The legs 24, 26 extend in different transverse directions relative to the axis 14. The inner leg 24 is referred to as "inner" as it connects the outer leg 26 to the shank portion 12. The outer leg 26 terminates in a terminating tip 30 that is used to initially wedge and engage objects. The terminating tip 30 includes a horizontally extending terminating edge 32.

Referring to FIGS. 1, 2, 4, 5, the outer leg 12 includes an inner face 34 and an outer cam face 36 which face axially toward and axially away from the shank portion 12, respectively. The outer cam face 36 continuously curves and is free of defined flats from the apex 28 to the terminating tip 30 and edge 32. With this configuration, the outer cam face 34 provides a moving fulcrum. During prying with the U-Shaped hook 16, and in contrast to prior pry bar designs (which have defined flats across extending across the majority of the outer leg), the fulcrum starts at the terminating tip 30 proximate the terminating edge 32 and moves along the leg toward the apex 28 as prying occurs. This provides beneficial camming action during prying across a much larger range of movement. Having a fulcrum that moves starts near the terminating edge 30 and that extends over a substantial portion of the outer leg 26 thus provides an advantage for many applications of the pry bar 12.

Figure 4:
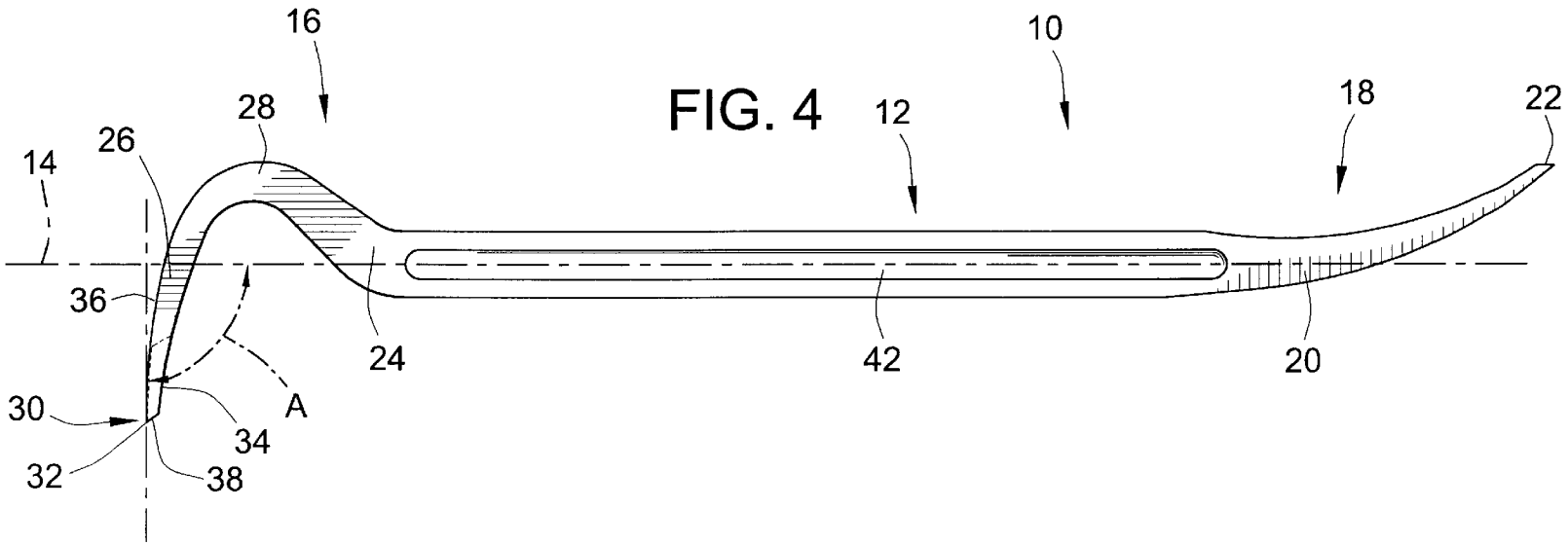
FIG. 4 is a right side view of the pry bar shown in prior Figures.
Figure 5:
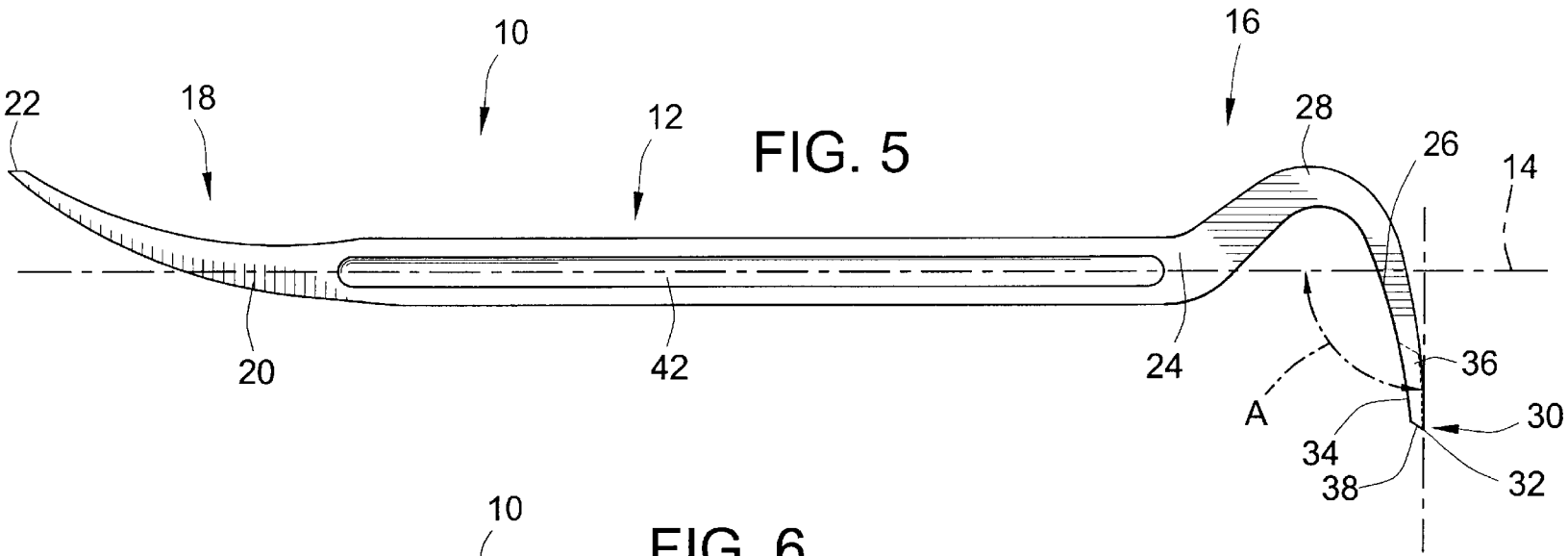
FIG. 5 is a left side view of the pry bar shown in prior Figures.
Figure 6:
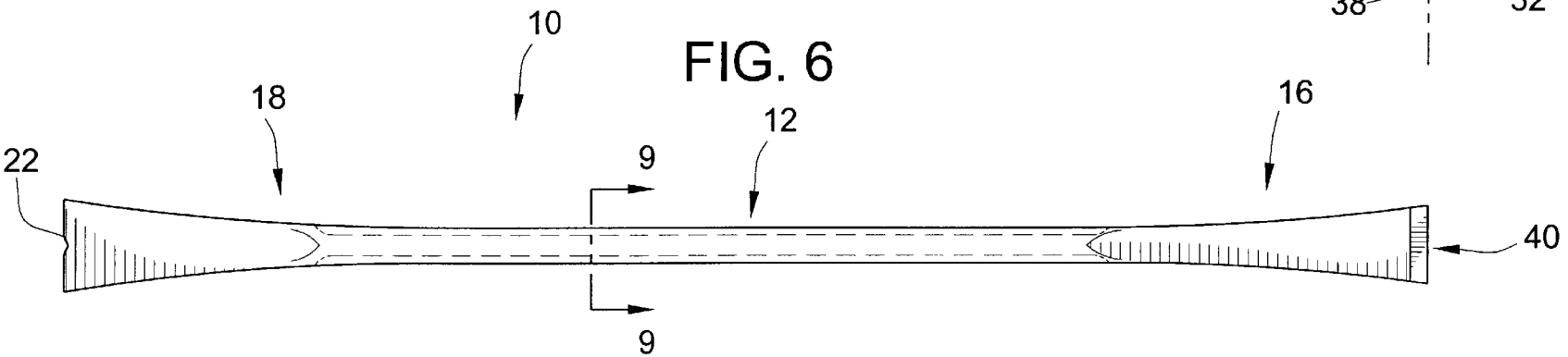
FIG. 6 is a bottom side view of the pry bar shown in prior Figures.

Preferably, the outer cam face 36 of the outer leg 26 converges toward a limit that forms about a 90 degree angle A with the axis 14 as indicated in FIG. 4. A beveled edge 38 may be provided along the inner face 34 at the terminating tip 30 to help users maneuver the pry bar 12 into an operable prying position. A V-shaped nail slot 40 may also be defined at the terminating tip 30. The V-shaped nail slot 40 can be used to receive heads of nails or other fasteners to facilitate pulling and removal of such nails or fasteners.

Another feature of the disclosed embodiment is the formation of axially extending channels 42 in opposed sides of the shank portion 12. To maximize strength, the channels 42 are preferably formed in opposed lateral sides of the pry bar 12 such that the channels 42 are disposed along sides which are perpendicular relative to the a vertical direction in which the pry bar is operated for prying.

Figure 9:
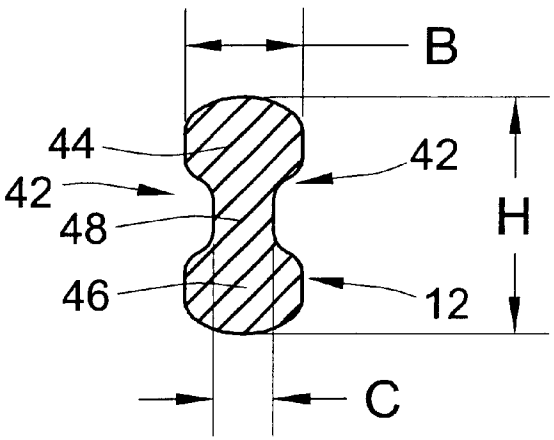
FIG. 9 is an enlarged cross section of FIG. 6 taken about line 9—9.
Figure 8:
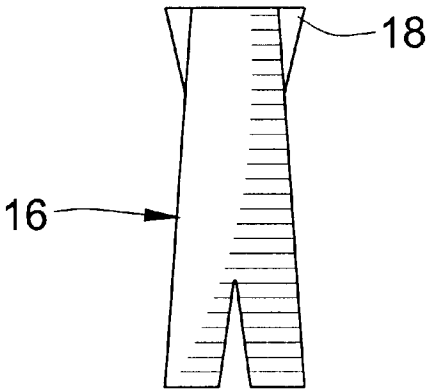
FIG. 8 is an end view of the prying hook end of the pry bar shown in prior Figures.
Figure 7:
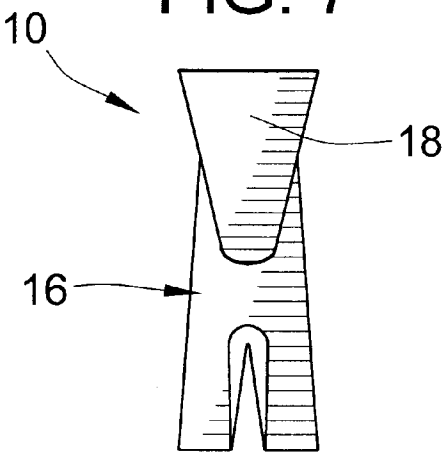
FIG. 7 is an end view of the prying chisel end of the pry bar shown in prior Figures.

With the channels 42 formed into the pry bar 10, the shank portion 12 defines a generally I-shaped cross section when it is cut along a plane perpendicular to the axis 14, as shown in FIG. 9. Referring to the cross section of FIG. 9, the shank portion 12 when provided with channels 42 has top and bottom beam portions 44, 46 that are integrally and unitarily connected through an intermediate beam portion 48. This provides the pry bar 12 with a variable width (including a maximum width B and a minimum width C) and a maximum height H.

Preferably, the maximum width B of the top and bottom beam portions 44, 46 are between about 150% and about 250% of the minimum width C the intermediate beam portion 48. The height H of the shank portion 12 is between about 250% and about 500% of the minimum width C of the intermediate beam portion 48. The advantage of the inventive pry bar construction is that it may be used to increase strength or decrease weight. The configuration allows for an increase in height H (in the direction of prying) without necessarily increasing the weight of the bar. This configuration can increase the moment loads and therefore the maximum torque which the pry bar 12 can carry. Advantageously, weight may be reduced and strength may also be increased at the same time. The configuration also provides a good gripping surface for users.

The pry bar may come in a variety of sizes or axial lengths. Practical sizes for many applications range from about fourteen inches to about thirty-six inches, although any size may be used. Within this size range, the maximum width B of the top and bottom beam portions 44, 46 is between about 0.4 and about 0.7 inches, the minimum width of the intermediate beam portion 48 is between about 0.2 and about 0.4 inches, and the height H is between about 0.8 and 1.2 inches.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pry bar, comprising:

a shank portion extending along an axis;

a U-shaped prying hook integral with the shank portion, the U-shaped prying hook having an inner leg and an outer leg meeting at an apex and extending in different transverse directions relative to the axis, the inner leg connecting the outer leg to the shank portion, the outer leg terminating in a terminating tip, the outer leg including an inner face and an outer cam face facing axially toward and axially away from the shank portion respectively, the outer cam face continuous curving and being free of defined flats from the apex to the terminating tip; and axially extending channels formed into opposed sides of the shank portion, and wherein the channels terminate at or prior toan intersection between the shank portion and the U-shpaed portion, such that the channels do not extend into the inner leg.

2. The pry bar of claim 1, wherein the outer face of the outer leg converges toward a limit that forms about a 90 degree angle with the axis.

3. The pry bar of claim 1, further comprising a prying chisel unitary with the shank portion, the prying chisel and the U-shaped prying hook being disposed on opposing ends of the shank portion.

4. The pry bar of claim 1, wherein the inner and outer faces of U-shaped prying hook continuously taper toward each other as the U-shaped prying hook extends to the terminating tip.

5. The pry bar of claim 4, further comprising a beveled edge along the inner face at the terminating tip.

6. The pry bar of claim 1, wherein the shank defines top and bottom generally rounded surfaces.

7. The pry bar of claim 6, wherein the opposing sides for the channels are lateral sides that are angularly disposed in perpendicular orientation relative to the inner and outer faces.

8. The pry bar of claim 7, wherein the shank portion defines a generally I-shaped cross section perpendicular to the axis having a height and a width, with top and bottom beam portions and an intermediate beam portion, the maximum width of the top and bottom beam portions being between about 150% and about 250% of a minimum width the intermediate beam portion.

9. The pry bar of claim 8, wherein the height is between about 250% and about 500% of the minimum width of the intermediate beam portion.

10. The pry bar of claim 9, wherein the maximum width of the top and bottom beam portions is between about 0.4 and about 0.7 inches, the minimum width of the intermediate beam portion is between about 0.2 and about 0.4 inches, and the height is between about 0.8 and 1.2 inches.

11. A pry bar, comprising:

a shank portion extending along an axis;

at least one prying tip integrally connected to the shank portion; and axially extending channels in opposed sides of the shank portion, wherein the shank portion defines a generally I-shaped cross section perpendicular to the axis having a height and a width, with top and bottom beam portions and an intermediate beam portion, wherein the top and bottom beam portions define generally rounded top and bottom surfaces along the shank portion.

12. The pry bar of claim 11, wherein the at least one prying tip comprises a prying chisel unitary with the shank portion and a U-shaped prying hook unitary with the shank portion, the prying chisel and the U-shaped prying hook being disposed on opposing ends of the shank portion.

13. The pry bar of claim 12, wherein the U-shaped prying hook has an inner leg and an outer leg meeting at an apex and extending in different transverse directions relative to the axis, the inner leg connecting the outer leg to the shank portion, the outer leg terminating in a terminating tip, the U-shaped the outer leg including an inner face and an outer cam face facing axially toward and axially away from the shank portion respectively, the outer cam face continuous curving and being free of defined flats from the apex to the terminating tip.

14. The pry bar of claim 13, wherein the outer face of the outer leg converges toward a limit that forms about a 90 degree angle with the axis.

15. The pry bar of claim 13, wherein the inner and outer faces of U-shaped prying hook continuously taper toward each other as the U-shaped prying hook to the terminating tip.

16. The pry bar of claim 13, further comprising a beveled edge along the inner face at the terminating tip.

17. The pry bar of claim 11, wherein the opposing sides for the channels are lateral sides that are angularly disposed in perpendicular orientation relative to the a vertical direction in which the pry bar is operated for prying.

18. The pry bar of claim 17, wherein the maximum width of the top and bottom beam portions are between about 150% and about 250% of a minimum width the intermediate beam portion.

19. The pry bar of claim 18, wherein the height is between about 250% and about 500% of the minimum width of the intermediate beam portion.

20. The pry bar of claim 19, wherein the maximum width of the top and bottom beam portions is between about 0.4 and about 0.7 inches, the minimum width of the intermediate beam portion is between about 0.2 and about 0.4 inches, and the height is between about 0.8 and 1.2 inches.

* * * * *

UNITED STATES PATENT AND TRADEMARK OFFICE

CERTIFICATE OF CORRECTION

PATENT NO. : 6,752,380 B1
DATED : June 22, 2004
INVENTOR(S) : Robert L. Taylor et al.

It is certified that error appears in the above-identified patent and that said Letters Patent is hereby corrected as shown below:

Column 4,
Line 26, change "U-shpaed" to -- U-shaped --.

Signed and Sealed this

Thirty-first Day of August, 2004

JON W. DUDAS
*Director of the United States Patent and Trademark Office*